United States Patent [19]

Gál et al.

[11] Patent Number: 4,533,912

[45] Date of Patent: Aug. 6, 1985

[54] EQUIPMENT FOR DISPLAYING ALPHANUMERICAL AND/OR PICTORIAL INFORMATION, PREFERABLY FOR USE ON A VEHICLE

[75] Inventors: József Gál; András Gyárfás; László Katkó ; Gábor Rácz; Ágoston Sarlós; Gyula Vozári, all of Budapest, Hungary

[73] Assignees: Budapesti Muszaki Egyetem; Ikarus Karosszeria es Jarmugyar, both of Budapest, Hungary

[21] Appl. No.: 470,176

[22] Filed: Feb. 28, 1983

[51] Int. Cl.[3] ..... G09G 3/34

[52] U.S. Cl. ..... 340/783; 340/815.09; 340/815.27; 340/764

[58] Field of Search ..... 340/815.24, 815.26, 340/815.27, 815.29, 815.05, 815.08, 815.09, 764

[56] References Cited

U.S. PATENT DOCUMENTS

| | | | |
|---|---|---|---|
| 2,141,473 | 12/1938 | Hubertz | 340/815.27 |
| 3,307,170 | 2/1967 | Aoyama et al. | 340/815.27 |
| 3,373,422 | 3/1968 | Aiken | 340/815.26 |
| 3,451,055 | 6/1969 | Pihl | 340/815.26 |
| 3,949,392 | 4/1976 | Caritato | 340/764 |
| 4,161,832 | 7/1979 | Bergamini | 340/764 |
| 4,268,821 | 5/1981 | DeSmet | 340/815.27 |

*Primary Examiner*—Gerald L. Brigance

*Attorney, Agent, or Firm*—Anthony H. Handal

[57] ABSTRACT

An equipment is disclosed for displaying alphanumerical and/or pictorial information offering a high working reliability even in case of unfavorable working conditions.

The plate of a display board is provided with a ground-color painted surface wherein one or more apertures are shaped along one or parallelly running more axes. Tiltable masks are arranged behind the aperture/s/ along at least one row in a manner that they may by tilting them be turned through the said aperture/s/ so as to cover each one dot of the surface of the said plate. The color of the masks is differing from the ground-color. The display pattern selection is performed by a mechanism comprising two levers arranged in different heights and angle positions at the body of the mask and co-operating with a fixed buffer and another buffer which can be changed over between two working positions the said buffers being arranged on a carriage displaceable along the plate.

1 Claim, 7 Drawing Figures

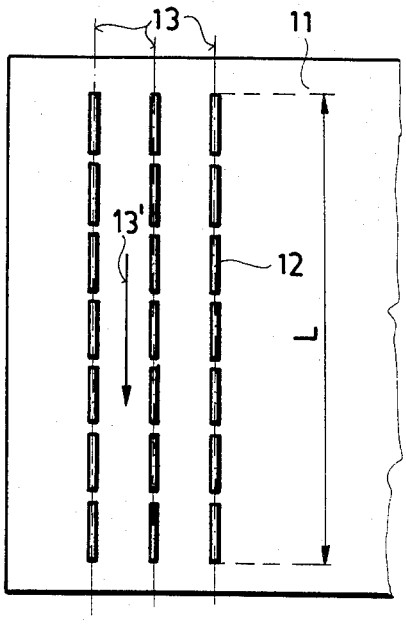
Fig. 1.a
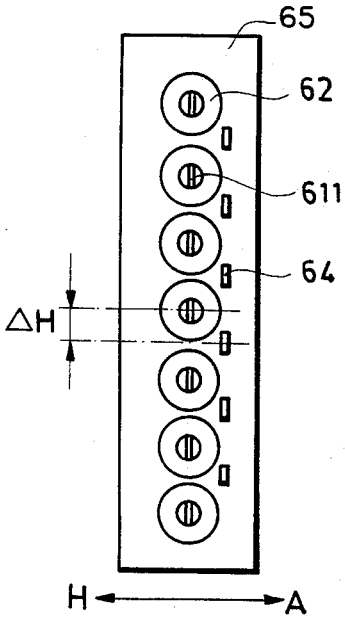
Fig. 2
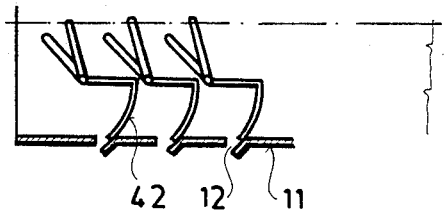
Fig. 1.b
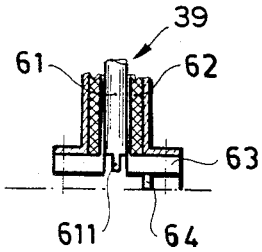
Fig. 6

EQUIPMENT FOR DISPLAYING ALPHANUMERICAL AND/OR PICTORIAL INFORMATION, PREFERABLY FOR USE ON A VEHICLE

FIELD AND BACKGROUND OF THE INVENTION

The invention relates to an equipment by the aid of which alphanumerical and/or pictorial information can be displayed even under unfavorable working conditions. The invention can preferably be used on a vehicle or such other establishment where disturbing factors causing instability may arise, however the working features of the display equipment should not be allowed to be disturbed by such adverse conditions. It is a special advantage of the invention that many embodiments based on some common main features but differing otherwise considerably from each other may be built so that any special requirement can be complied with: the embodiment may be a manually operated primitive display device as well as a sophisticated equipment having large dimensions and many features, among others, the possibility of automatically changing the displayed pattern according to a time-table. It is a common structural feature of all embodiments that the essential operating, actuating devices according to the invention are uniform modular elements which may be arranged in any desired number and combination and this is very favorable especially as far as the possibility of wholesale manufacture, the interchangeability of components, and the universality of operating conditions are concerned.

Various solutions have been developed for displaying alphanumerical and/or pictorial information and they may be assorted according to different criteria. A widespread group of means for displaying both alphanumerical and pictorial information includes equipment comprising a matrix-type display board. This group may further be broken down if one considers whether the dots formed in the nodes of the matrix are of the so-called active or the so-called passive type. Active dots are, e.g., those formed by a light source (incandescent lamp, cold light source, light-emitting semi-conductor, ett.). Such dots are during the whole displaying period continuously emitting light energy causing thereby an either smaller or greater but a continuous energy consumption. The use of so-called passive dots allows the reduction of energy consumption which may in this case often be restricted to the energy needs of the control means; sometimes there arises also a minor energy consumption for turning a dot into and, if necessary, positively holding it in its actuated state. One of the known passive dot type display boards is comprising a plate the surface of which is painted in a certain color (hereinafter: ground-color) and carries a plurality of annular dots forming the nodes of a matrix. The dots are prepared by leaving a semi-circle of the dot ground-color painted and painting the other semi-circle in a different color, and a semi-circular cover plate painted on its one side in the ground-color and on its other side in the different color is arranged at each dot in a manner that it can be rotated around the median line of the dot by 180° in order to cover the one working position the ground-color painted semi-circle of the plate and, thus, show an annular dot of the different color, whereas in the other working position the differently colored semi-circle of the plate is covered and the dot is, thus, shading into the ground-colored surface of the plate.

The matrix-type equipment comprising active or passive dots according to the prior art requires either a skilled personnel or an automatic—usually electronic—control unit leaving only simple manipulations to the operating layman. The known equipment are all more or less susceptible to the instability factors prevailing in the working area. With vehicles, the main instability factors are the considerable shaking effects; frequent deviations from the horizontal position to a widely varying extent; vibrations due to changes in speed; an enormous contamination; considerable changes in the ambient conditions, such as, temperature and precipitation exerting a direct influence on the working area. In this field of application, a robust operating mechanism is necessary. Since the operation shall usually be performed by laymen, a solution is sought for which does require no cyclical maintenance and, qualitatively as well as quantitative, a minimum interference on the side of the operator. The solution should afford an easy manipulation for laymen without the need of expensive automatic control devices but with the possibility of improving the basic mechanism, if needed, with a versatile and high-capacity automatic control means.

SUMMARY OF THE INVENTION

The invention is based on the concept that the desired robuts character can be obtained by making an exclusively mechanical interconnection between the modular type actuating devices and also between the display elements, and performing the pattern-dependent changes in the state of the actuation devices by means of electromechanical switches in a manner that a simple embodiment offering minimum facilities not only the electromechanical switching devices performing the pattern selection may manually be operated but also a manually driven moving mechanism may be used whereas an embodiment designed to afford maximum facilities may not only comprise an up-to-date electric or electronic drive but also the up-to-date electronic data processing and transmitting means may widely be applied for controlling the electromechanically operated actuating devices in a manner that even a multitude of different display patterns may in the form of actuating instructions, be stored and the read-out of the just needed pattern may be controlled by a software package performing automatic display pattern selecting and changing; furthermore, central instructions may be transmitted through wireless telecommunication channels to the simple control units equipped with minimum facilities and arranged on the single vehicles whereas common instructions may, over a common channel, be transmitted to all vehicles and different instructions for any single vehicle or a certain group of vehicles may be transmitted through a complex of selective channels. It can be seen from the above that an accordingly controlled display board arranged on a vehicle may perform much more than barely displaying advertisements: a traffic remote control center as well as the driver of the very vehicle may, if needed, use the display board to communicate information with the passengers just preparing to get on the vehicle and, even acoustic signals may be used to draw their attention to the information appearing on the display board. The display board may likewise be arranged inside the vehicle; it is already usual in some big cities to run special tourist route trams equipped with a magnetic tape recorder which is successively supplying information concerning the sights crossed during the ride; such tape recorder service may be either completed or replaced by a display board according to the invention arranged inside the carriage.

The display board according to the invention comprises a plate having a ground-color (e.g. black) painted surface wherein one or more apertures are formed next and parallel to each column of dots, and tiltable masks are arranged behind the apertures in a manner that they may, by tilting them, be turned through the apertures so as to cover each one dot of the surface of the plate, the color of the masks is different from the ground-color (e.g. white), and two levers are in different heights and at angular positions arranged on the body of each mask in a manner that the first lever is in the tilted state of the mask extending beyond a plane, hereinafter called the actuating plane, lying parallel to the plate, and the second lever is in the home position of the mask extending beyond the actuating plane so that the levers, in the mentioned states of the mask, respectively, protrude into the path of an actuating carriage arranged behind the plate and preferably coupled with a drive, the path running along the plate parallel to the rows, and the actuating carriage is carrying as many actuating devices as there are dots in a single column. The actuating devices are arranged along a line lying perpendicularly to the rows and each actuating device is equipped with a fixed first buffer and a second buffer having two working positions and coupled with an electromechanical switch for changing its working position.

Although the display board according to the invention is preferably of the matrix type, the dots are arranged in more rows and, accordingly, in columns comprising as many dots as there are rows in the matrix, however such embodiments may advantageously comprise only a single row of dots. With such embodiments of the invention, there are properly speaking no "columns" in the usual meaning of the term, since each "column" comprises only a single dot, but the working mode is the same and, the actuating of any dot is performed in the same way as though there were a plurality of rows so that any single dot of the single row may be considered a column of the display board and the term "column", as far as the scope of the invention is concerned, is understood in such broad a sense. In this case, also the actuating carriage is equipped with only a single actuating device and there are as many devices as there are dots in a single column.

The equipment may comprise a control unit to the selective outputs of which are coupled the control inputs of the electromechanical switches of the different actuating means. The control unit may comprise a well-known random access memory, preferably a memory of the RAM type, means for performing a selection from a plurality of display patterns stored in the memory. If the change of the display pattern shall be performed automatically, e.g. according to a time-table, the means for performing the pattern selection are coupled with a means for performing an automatic, e.g. cyclical, display pattern change.

BRIEF DESCRIPTION OF THE DRAWINGS

The invention will now be described with reference to the attached drawings showing essential parts of a preferred embodiment of the invention.

FIG. 1 shows a part of the display board of the preferred embodiment, namely

FIG. 1*a* its side view and

FIG. 1*b* its plan view;

FIG. 2 shows an embodiment of the actuating carriage displaceable behind and along the plate;

FIG. 6 shows a part of an embodiment of the electromechanically operated actuating means.

DESCRIPTION OF THE PREFERRED EMBODIMENT

Figure 3:
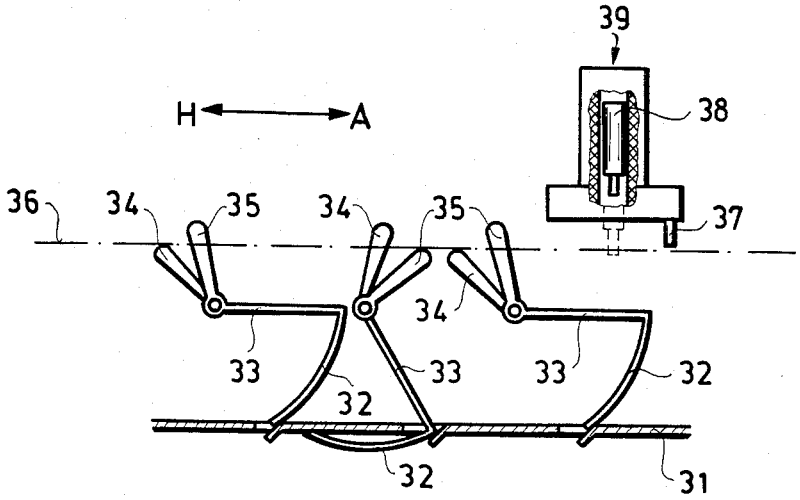
FIG. 3 shows the mutual arrangement of the plate of the display board and the actuating carriage and of the tiltable masks arranged between the plate and the carriage.

The surface 11 of the plate partially shown in FIG. 1*a* is painted in a ground-color (such as black). It can be seen that there are apertures 12 shaped in the plate along the axes 13 running parallel to the direction (see arrow 13') of the columns of dots. Tiltable masks 41 and 51 (more particularly shown at FIGS. 4 and 5) are arranged in a manner as shown in the FIG. 1*b* behind the apertures 12 so that they may be swivelled (around their axis of rotation 56, see FIG. 5) whereby the displaying arc 32, 42, 52 being part of the mask 41, 51 is crossing the aperture 12 and covering a part of the surface 11 to form a dot (the outer surface of the displaying arc 32, 42, 52 being painted in a color visibly differing from the ground-color). It is clear that the dot-forming operation may also be performed if a common aperture extending along the whole column and having, thus, a length L instead of the plurality of short apertures 12. In this case the space between two adjacent masks 41, 51 of one and the same column would not show the ground color along the width of the aperture 12 (where there is no plate) that the clearness of the image could slightly be affected.

Figure 4:
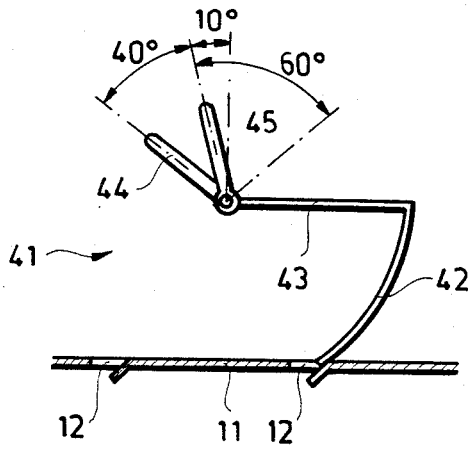
FIG. 4 is a schematical view of the mask in a plane lying perpendicularly to its axis of rotation showing also the relevant part of the plate.
Figure 5:
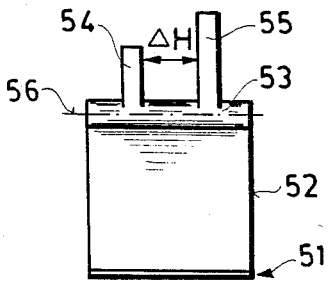
FIG. 5 is a schematical view of the mask similar to the one as shown in FIG. 4 but its being swivelled by 90°.

It can more clearly be seen if considering the FIGS. 4 and 5 that the masks 41, 51 are comprising a displaying arc 42, 52 which may be swivelled around the axis of rotation 56 to cover a certain part of the surface 11. The color of the outer surface of the arc 42, 52 shall be chosen such that a highest possible contrast be obtained between the dot appearing in the tilted state of the mask 41, 51 and the then visible area of the surface 11. If, e.g. the ground-color is black, the different color may be white, etc. It can be seen that the displaying arc 42, 52 is fixed to a radially positioned crank 43, 53 these parts being expediently forming a monolithic piece and supported by an axle arranged parallelly to both the plane of the plate and the direction 13' of the column whereas either the crank 43, 53 is fixed to the axle and the latter one is supported in a hinged manner or the connection between the axle and the crank 43, 53 is a hinged one and the axle is rigidly fixed to a support. The levers 44, 45, 54, 55 are fixed to the body of the mask in different heights and angle positions. It can be seen at FIG. 4 that the angular width between the first lever 44, 54 and the second lever 45, 55 amounts in the shown embodiment up to 40°, the angular width between the second lever and the crank 43, 53 is about 100°, and the angular width between the home position and the tilted position of the mask 41, 51 amounts up to 60° whereas the difference in height between the first lever 44, 54 and the second lever 45, 55 is of a value H chosen appropriately as to prevent any disturbing mutual effect as far as the independent operations towards the first lever 44, 54 and towards the second lever 45, 55 performed by the actuating device are concerned. Looking now at FIG. 3, it can be seen that the axle supporting the crank 33 is arranged parallel to the plate and to the direction 13' (FIG. 1*b*). The space between the axle and the plate is chosen so as to ensure that the distance between the axle and the relevant aperture 12 be equal to the length of the crank 33 (i.e. the radius of the swivelling path) and the actuating device 39 is at its carriage 65 (see FIG. 2) arranged in a manner that the ends of its buffers 37, 38 are directed towards the plate in a position that they are causing the displacement of the actuating carriage 65 (the second buffer 38 only in its actuated state) to sweep a plane 36 which is, thus, bordering the path of the carriage 65 and will hereinafter be called: actuating plane 36. It can also be seen that the first lever 34 is in its tilted state extending beyond the actuating plane 36 and, thus, extending into the path of the actuating carriage 65, whereas the second lever 35 is in its home position extending beyond the plane 36. These two features are necessary for the correct actuating operation, i.e. during a displacement of the actuating carriage 65 in the actuating direction A, the actuated second buffer 38 will exert a torque upon a mask found in its home position through the second lever 35 and during the displacement in the reverse (home) direction H, the first buffer 37 will exert a torque upon a mask being in its tilted position through the first lever 34. It is, however, not absolutely necessary to ensure that the levers 34, 35 be only in one of the two positions extending into the path. If the fixed buffer 37 is, e.g. radially fixed to a properly directed ratchet-like support, the working will not be disturbed even if the first lever 34 is in both positions extending into the path because the first buffer 37 will, if approaching the first lever 34 in the actuating direction A, deviate without exerting force upon same, whereas if approaching the lever 34 in the home direction H, the buffer 37 will not deviate but enforcing the return of the mask into the home position through the lever 34. For sake of easier understanding, we will hereinafter support that each lever 34, 35 is only in one of its two positions extending into the path of the carriage 65.

FIG. 6 is showing some particulars of an embodiment of the electromechanically operated actuating device 39. An electromagnet having a coil 62 is used; its armature 61 is in its home state entirely surrounded by the coil 62 and in its actuated state displaced towards the actuating plane 36 so that its pin 611 be at least touching but preferably extending beyond the plane 36. The fixed buffer 37 is performed as a pin 64 sticking out of the body 63 and also touching or extending beyond the plane 36. The second buffer 38 is formed by the pin 611 of the armature 61. FIG. 2 is showing the arrangement of the actuating devices 39 on the actuating carriage 65.

Persons ordinarily skilled in the art may now easily follow the working mode of the equipment.

When a displacement of the carriage 65 in the actuating direction is performed either manually or mechanically, it will sequentially pass all columns of the board. Whenever it is approaching the next following column, those electromagnets will be actuated which belong to the dots to be actuated in that column so that the second buffers 38 of these devices 39 will cause a tilting of the relevant mask; the outer surface of their displaying arc 32, 42, 52 will emerge as a differently colored dot on the surface 11 on the plate. It becomes clear that the representation of a dot may also be performed by applying the different color only to a certain part of the outer surface of the displaying arc 32, 42, 52 obtaining thus an annular, a square, or a triangle etc. shaped dot. In this case, the remaining part of the outer surface of the arc 32, 42, 52 may preferably be left ground-colored but other combinations are also possible. In the case of a single column embodiment, the actuating of the chosen devices 39 may also be performed before driving the carriage 65 along the path. If, however, the board comprises more than one column, the pattern selection may only be performed by sequential operations distributed over the displacement period so that it may not be performed manually. It is, therefore, the basic working mode of the equipment that the pattern selection is not performed manually but even then its performance may be varying: different methods and different devices may be developed for this purpose. It may be advantageous to use cam discs each shaped according to a selected pattern for a certain row of dots and each arranged next to the row it belongs to in a manner as to control the actuating of the masks belonging to such row sequentially during the displacement of the carriage 65. In this case, the change of the display pattern may be performed by replacing the cam disc(s) of one or more rows by other ones representing the desired next pattern. If electronic devices for performing the pattern selection and pattern change can without any difficulty be applied under the prevailing working conditions, the control inputs of the actuating devices 39 may be connected to the proper output(s) of an electronic control unit. It is obvious for persons ordinarily skilled in the art that if using electronic control devices, there are hardly limits as to the variability, the diversification, and any extension of the services. The sortiment of patterns to be displayed be it a text, a picture or a set of cylically repeated patterns may be stored in a memory such as a ROM whereas the read out of the just wanted pattern(s) may be performed by manual interference as well as by either a local or a central automatic program and pattern selection. Whenever a pattern having been set by operating the activating devices becomes superfluous, the actuating carriage 65 is moved in the home sense along the actuating plane 36 and the fixed first buffers 37 are over the first levers 34 restituting the home state for the whole board.

The invention can be embodied as a—nowadays widely used—display board comprising so-called character arrays consisting of, e.g., $5\times7$ dots; this type is also apt to display pictorial patterns, however, for this purpose it is preferable to use boards of the very matrix type, i.e. where the whole set of dots is uniformly distributed to form dots in the nodes of a matrix network which may be actuated entirely independently of each other. In the case of electronic control, such differences in arrangement and organization are only affecting the design of the controlling software: the range of patterns which may be displayed is for all kinds of organization just the same if equal ranges of capacity are concerned. It has already been mentioned that the pattern forming facility may be improved if also the outer surface of the mask represents a special pattern instead of a simple uniformly colored surface.

The choice of the mechanical and electrical features of a given embodiment involve, of course, also a lot of further problems to be cleared up as far as either the choice of system features or the choice of components is concerned but this does not touch the scope of the invention. With embodiments where the actuating carriage is manually driven, the reliability of the working features may be increased if using a regulator (like in telephone dials) in order to stabilize the speed of displacement notwithstanding the instability of the mutual operation. Cyclically repeated sequences of patterns may be stored in tape cassettes or other infinite tapes etc. The working mechanism of a cam disc may be replaced by a punched paper tape serially storing the instructions for the actuating devices following each other in one and the same row.

Summing up the above, the invention affords a wide variety concerning the fields of application as well as the different working modes, the choice of controlling and storing facilities and accessories, whereas it is a common feature of all embodiments that the use of a set of electromechanically controlled and mechanically working actuating devices as proposed by the invention, affords exceptionally favorable conditions for the design, the manufacture, and the working of the equipment according to the invention.

We claim:

1. An equipment for selectively displaying alphanumerical and/or pictorial information, preferably for use on vehicles, comprising:

a matrix-type display board including passive, two-state dots arranged in at least one column, the display board comprising a plate having a ground-color painted surface (11) wherein at least one aperture (12) is formed adjacent and parallel to each dot in said column of dots, a plurality of tiltable masks (41, 51) arranged behind said apertures (12), a plurality of tilting means, each for tilting a respective one of said masks through an associated one of said apertures (12) for covering in a tilted state one dot of the surface (11) of said plate, and for uncovering in a home state said one dot, the color of at least a portion of an outer surface of said masks being different from the said ground-color, each said tilting means comprising two levers (44, 45, 54, 55) mounted at different heights and angle positions and attached to the respective mask (41, 51), said first lever (44, 54), when in the tilted state of the mask (41, 51), extending beyond an actuating plane (36), and the second lever (45, 55), when in the home position of the mask (41, 51), extending beyond the said actuating plane (36) so that said levers (44, 45, 54, 55) at said states of the mask (41, 51), respectively, extend into the path of an actuating carriage (65) arranged behind said plate, said actuating carriage (65) being coupled with a drive, said path running along the plate parallel to said column, said actuating carriage (65) carrying actuating devices (39), one for each of said dots in said column, said actuating devices (39) being arranged along a line lying perpendicular to said column, each actuating device (39) including a fixed first pin (37) and a second actuating pin (38) having a rest and an actuated position, and, means coupling an electromechanical switch to said second actuating pins for selecting said actuated position to selectively operate said display.

* * * * *